US006892500B2

(12) United States Patent
Zaborowski

(10) Patent No.: US 6,892,500 B2
(45) Date of Patent: May 17, 2005

(54) SUSPENDED CEILING SUPPORT STRUCTURE

(75) Inventor: Stanislaw Zaborowski, Ottawa (CA)

(73) Assignee: VIB Inc., Ottawa (CA)

( * ) Notice: Subject to any disclaimer, the term of this patent is extended or adjusted under 35 U.S.C. 154(b) by 0 days.

(21) Appl. No.: 10/431,435

(22) Filed: May 8, 2003

(65) Prior Publication Data

US 2003/0192268 A1 Oct. 16, 2003

Related U.S. Application Data

(63) Continuation-in-part of application No. 09/789,924, filed on Feb. 22, 2001, now abandoned.

(51) Int. Cl.[7] ..... E04B 2/00; E04B 5/00; E04B 9/00

(52) U.S. Cl. ..... 52/506.06; 52/506.07; 52/506.01; 52/664

(58) Field of Search ..... 52/506.06, 506.07, 52/506.08, 506.09, 506.1, 512, 456, 461, 463, 464, 466, 664, 665; 403/326, 327, 329, 317, 316, 381

(56) References Cited

U.S. PATENT DOCUMENTS

| | | | | | |
|---|---|---|---|---|---|
| 2,059,483 | A | | 11/1936 | Parsons | |
| 2,229,064 | A | | 1/1941 | Finch | |
| 3,228,163 | A | | 1/1966 | Lindstrom | |
| 3,612,461 | A | * | 10/1971 | Brown | 248/317 |
| 3,671,061 | A | | 6/1972 | Dawdy | |
| 3,969,865 | A | | 7/1976 | Andersen | |
| 4,549,375 | A | | 10/1985 | Nassof | |
| 5,313,759 | A | * | 5/1994 | Chase, III | 52/506.06 |
| 5,396,748 | A | * | 3/1995 | Rogers | 52/664 |
| 5,611,185 | A | * | 3/1997 | Wilz | 52/506.07 |
| 5,768,843 | A | | 6/1998 | Dziedzic | |
| 6,101,777 | A | * | 8/2000 | Bodine et al. | 52/506.06 |
| 6,205,732 | B1 | | 3/2001 | Rebman | |
| 6,205,733 | B1 | * | 3/2001 | LaLonde | 52/506.07 |
| 6,318,042 | B1 | * | 11/2001 | Bloom et al. | 52/506.07 |

* cited by examiner

*Primary Examiner*—Carl D. Friedman
*Assistant Examiner*—Chi Q. Nguyen
(74) *Attorney, Agent, or Firm*—David J. French

(57) ABSTRACT

A ceiling support system for a suspended ceiling is provided that includes resilient clamps for attachment to the underside surface of a structural ceiling and inter-engaging ceiling runners that are shaped to be fitted into and be grasped by such clamps. The engagement edge of the runner is shaped to allow the runner to maintain multiple stable positions: a normal, ceiling panel supporting orientation, and a canted orientation for installation of ceiling panels. Runners may be joined end to end with an engagement piece. Cross-runners may be joined to runners with an engagement piece inter-fitted with a connector plate mounted transversely in the web of a runner.

6 Claims, 10 Drawing Sheets

SUSPENDED CEILING SUPPORT STRUCTURE

This application is a Continuation-In-Part of the U.S. application Ser. No. 09/789,924 filed on Feb. 22, 2001 now abandoned.

FIELD OF THE INVENTION

This invention relates to suspended or drop ceilings. More particularly it relates to the structural grid of a suspended ceiling system that holds ceiling panels in place and to methods for installing and removing such ceiling panels.

BACKGROUND TO THE INVENTION

Suspended ceilings are employed today in many structures because they provide an aesthetic presentation while enabling the routing of hardware such as conduits, electrical wiring, etc, in the gap between the suspended ceiling panels and the structural ceiling of the building itself. This gap also provides a convenient "headspace" whereby ceiling panels may be inserted through openings in a ceiling support grid system and manipulated into an orientation whereby the panels may be lowered onto supporting flanges within the grid system that provide shelves or ledges onto which the edges of the ceiling panels may rest.

According to one mode of construction, the support grid for a suspended ceiling relies on the use of longitudinally extending strips or "runners" that are generally of an inverted "T"-shape in cross-section, having outwardly protruding lateral flanges which provide the ledges upon which the ceiling panels rest. In this type of existing system suspension wires or other connectors descend from the ceiling proper, through the headspace, to connect with the ceiling runners.

In conventional suspended ceiling systems having substantial headspace, the procedure for installing or removing a ceiling panel is to lift the ceiling panel clear of the grid support structure, turn it somewhat in the headspace, and then maneuver it down through the opening within the grid structure. The headspace required for lifting and maneuvering a ceiling panel in order to install or remove it is at least several inches and may, in some cases, take-up considerably more space.

However, in many cases provision of adequate headroom is impractical due to the relatively low height of the structural ceiling. Examples include the basements of homes where even the loss of a few inches in vertical height can give the impression that the ceiling is oppressively low. A need exists for a low headroom suspension ceiling support system that will permit tiles to be installed in place without reliance on the presence of headroom.

It is known to provide support for a drop ceiling through the use of resilient ceiling clips, resilient clamps or clamps. Examples of this type of construction are described in the following U.S. Pat. Nos. 2,059,483; 2,229,064; 3,228,163; 3,969,865; 4,549,375; 5,768,843 and 6,205,732. An advantage of using resilient mounting clamps is that ceiling panels can be placed in position without the necessity of manipulating them in a headspace provided above the gridwork system. This is advantageous when it is desired to keep the drop of the suspended ceiling at a minimum. Using resilient mounting clamps, ceiling tiles can be installed very nearly directly adjacent to the structural ceiling itself.

Retention systems for supporting the grid network of a suspended ceiling can be resilient, permitting the nondestructive disassembly of components by the application of a sufficient disengagement force. They may also be nonreversible, or not readily reversible in that they employ engagement mechanisms that may permit "snap-in" assembly procedures, but disassembly cannot be readily affected without risking the deformation of the engagement elements of the grid support system. Examples in this latter category are U.S. Pat. Nos. 3,784,184 and 4,720,946.

A specific example of a prior art reference addressing these requirements through use of resilient means is found in U.S. Pat. No. 3,263,388 to Bogert. This document discloses a system of interfitting runners and resilient clamps, the clamps being fastened to the structural ceiling itself. The clamps are provided with a serrated grasping face which engages a corresponding serrated face on an upwardly directed flange that forms the stem or leg portion of the inverted T-shaped cross-section for this member. Employing the Bogert system, ceiling panels are placed in position with their peripheral edges resting on the ledges provided by the lateral flanges of the runners. When the upwardly directed stem portion is pressed into the reception slot of the resilient clamps, the ceiling panels are carried along with the runners into their final position. A disadvantage of this system is that the ceiling tiles and runners must both be manipulated simultaneously. For a person standing on ladder or scaffolding, this requirement complicates the procedure of installing ceiling panel.

A need exists for a convenient support system for a suspended ceiling that can be readily installed and which permits the easy removal of the ceiling panels for replacement or access to the headspace behind such panels. It is an object of this invention to address such requirements.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to an embodiment of the present invention, a supporting framework for a suspended ceiling is provided based on a plurality of resilient clamps which are fastened in place beneath a structural ceiling. This may include the installation of clamps to the lower edges of joists or to strapping or other components of the structural ceiling. These clamps have a baseplate and resiliently expandable sides terminating at a pair of lips that define a nip. Within the clamps is an internal receiving space that is preferably open at both ends. The clamps may be intermittently disposed with their receiving spaces aligned, or may be in the form of continuous clamping bars that have suitable resilience.

A supporting grid for ceiling panels is provided through the use of longitudinal ceiling runners which are generally of an inverted "T" shaped in cross-section, having a pair of laterally extending support flanges that provide ledge surfaces for carrying ceiling panels. These ledges may underlie the ceiling panels or fit into slots on the edges of the ceiling panels in the known manner. Runners, according to the invention, also have an upwardly directed leg having a web portion and an enlarged, peripheral, clamp-penetrating engagement portion terminating in an edge at the end of the leg that is remote from the lateral flanges. In use, the clamp-penetrating portion of a runner is pressed through the lips of a clamp to penetrate into the internal receiving space of the clamp. A runner in this orientation is held in place by the clamp through the action of the lips grasping the web portion of the runner and/or the sides of the clamp-penetrating engagement portion of the clamp-engaging leg.

The runner is installed by passing the clamp-penetrating portion through the yielding nip of the clamp to permit the clamp to grasp the runner and hold it in place. The sidewalls of the clamp spread resiliently to permit such insertion by the application of modest manual force. Further, the lips on the clamp apply a sufficient retention force on the runner to resist the retraction of the clamp engaging end of the runner under forces of a magnitude that would normally arise from the supporting of ceiling panels. For this purpose, the peripheral end portion of the clamp engaging leg may be enlarged and in contact with the sides of the clamp.

To improve the retention capacity of the runners with respect to the clamps, the sides of the clamps may be angled as they approach the nip so as to tend to intersect at a greater angle than the sides remote from the nip.

As a preferred feature of the invention the enlarged, peripheral end portion of the clamp-engaging leg of the runner is preferably pointed and tapered with an entry taper that provides an easy entry and passage of such end portion through the lips of the nip. On the flange side of the clamp-penetrating engagement portion, the enlargement may or may not be provided with a peripheral taper. In a preferred variant, the flange side of the enlarged peripheral edge is formed with a niche that gives the engagement portion an arrow-head shape in cross-section but a trapezoidal shape, e.g. rhombic, may be employed as well.

Preferably, the height of the web from the lateral flanges to the enlarged end portion allows the enlarged edge to pass into the internal receiving space of the clamp until the enlarged end portion does not tend to spread the sides of the clamp. At this position the lips grasp the web. The clamps may be fastened to the structural ceiling through washers by which they may be adjusted into alignment.

It is a preferred feature of the invention that the engaging leg of the runner is of a shape which permits the runner to maintain either of at least two stable orientations with respect to the clamp when the clamp is engaged with the runner. In one orientation the engagement leg of the runner is aligned for direct entry into the interior space of the clamp. In this configuration the leg or web is generally perpendicular to the surface of the structural ceiling with the lateral flanges in a horizontal plane. The runner is then centrally located and symmetrically aligned with the clamp. Generally, in this orientation, the enlarged end portion on the runner may optionally be contacted or grasped by the sides on the clamp, and the web is grasped by the lips.

In another orientation, the runner is canted laterally, with the leg or web obliquely oriented with respect to its normal entry into the interior receiving space of the clamp. In this configuration the lateral flanges of one of a pair of runners intended for the support of a specific ceiling panel may be forced to one side, or both runners may be spread apart, to receive a ceiling panel. When two runners are spread apart the parallel, opposed, runners are canted in opposite directions. Alternately, only one runner need be canted with an edge of the panel first being inserted into the slot provided by the uncanted runner.

The degree of cant, and the length of the engagement leg, e.g. the depth of its web, is sufficient to provide a gap through which the ceiling panel may be manipulated without the necessity for the ceiling panel to penetrate into the headspace that is normally required to exist between a suspended ceiling and a structural ceiling. With the ceiling panel in place, the orientation of the supporting runners may be adjusted to the vertical, aligned position. In this orientation, the ceiling panel will be contained laterally and supported by the ledge surfaces of the lateral flanges on the respective runners.

According to one aspect of the invention, a canted stable orientation may be achieved by providing the peripheral end portion of the engagement leg of the runner with a shape that creates resistance to the slight rotation of the runner with respect to the clamp in either rotational direction when the runner is in its canted orientation. This may be achieved in one variant by providing the peripheral end with a shape that is approximate to, for example, a rhombic or a triangle in cross-section. When the shape is approximate to a rhombic, the opposed sides of the rhombic cross-section may be so nearly parallel to the respective sides of the clamp as to provide grasping surfaces which permit the clamp to engage and stably maintain the runner in the canted orientation.

By a further preferred variant of the invention, the peripheral edge of the runner is substantially arrow-head in cross-section whereby one of the lips of the clamp may engage the runner at a grasping surface formed in the niche beneath the arrow-head when the runner is at a canted orientation to provide a stable grasp on the runner. In all events, a meta-stable state will exist if a slight rotation of the runner in either direction tends to spread the lips of the clamp apart whereby a restoring force is created.

The shape of the clamp engaging portion, for example as an arrow-head, allows the runner to adopt a plurality of stable positions. When the runner is in an orientation such that the lateral flanges can support the ceiling tiles, i.e. a vertical orientation having the lips engaged with the web, any attempt to rotate the runner or to pull the runner out of its engaged position forces the resilient sides of the clamp to spread apart which oppose an increasing resistance. For small translational or rotational displacements, once the attempt ceases, the runner is pushed back into its original, fully engaged position by the clamp. When an applied rotational force is superior to the biasing forces exerted by the resilient sides of the clamp on the clamp engaging portion, one of the sides of the, for example, arrow head slides against one of the lips of the clamp. The runner then snaps into a new stable position where it assumes a canted orientation with respect to the clamp. Any rotation exerted on the runner from that new orientation then tends to spread the lips of the clamp apart, thus meeting an increasing resistance from the resilient sides of the clamp. This restoring force then tends to push the runner back into the stable canted position unless a threshold break-through limit is passed. This canted orientation is achievable on both sides. Thus three stable orientations are available.

The clamps may be generally triangular in cross-section and may be formed of any suitable resilient material e.g. spring steel, resilient plastic. The baseplate of the clamp may be flat or it may be dished inwardly into the interior receiving space of the clamp. In either case a fastening hole is formed in this baseplate through which a fastener may pass to engage with the structural ceiling.

By adoption of a resilient baseplate which is dished inwardly, the retention force at the nip of the clamp can be increased in accordance with the tightness with which this fastener engages the structural ceiling. The farther the dished configuration is flattened, the greater the increase in the grasping force at the nip.

To access a fastener seated in the fastening hole on the base plate an aligned notch may be present in the lips, the notch having sufficient width to allow a screwdriver to penetrate into the internal receiving space of the clamp.

In this manner a ceiling supporting framework is provided that extends longitudinally beneath a ceiling.

In the foregoing description the runners are mounted longitudinally in a parallel orientation to each other. To accommodate ceiling panels of limited length, transverse cross bars or cross runners may be provided.

Such cross runners may have an inverted "T" cross-section or the cross-section of an "I" beam. Lower flanges extending outwardly from one or both sides of the cross runners may engage or abut with the edges of ceiling panels to provide support and/or to conceal a seam.

The outer ends of the lower flanges on the cross-runners may be stepped upwardly by the thickness of the flange to provide a protruding plate that will rest on the lateral flange of a longitudinal runner. The height of the step aligns the lower surfaces of both classes of runners.

As an alternative to providing a bent step in the lower flange, a separate engagement piece may be fitted to the web at the end of a length of a cross runner to provide a pair of protruding plates that define a slot which will engage with a tab or upright connector plate that pierces the web of the longitudinal runner. The transverse connector plate is held in a vertical orientation at a fixed location along the web of the longitudinal runner by the sides of the web slot into which it is fitted. The engagement piece slot embraces the web of the cross runner optionally contained beneath an upper enlargement, stabilizing the engagement piece on the end of the cross runner.

In this arrangement, the engagement piece may be fitted to a standard longitudinal type runner to serve as a cross-runner, reducing the number of distinct components required. Optionally, the web on the cross-runner may be slotted to receive a bridge extending between the pair of plates of the engagement piece. In such case, the upper enlargement may be optionally present.

To stabilize and centralize the penetration of the upright plate through the slot in the web, two locking tabs may be erupted out of the surface of the upright plate. The edges of these tabs are positioned to bear against opposite sides of the longitudinal runner's web, adjacent to the slot. At least one of such tabs is resiliently compressible into alignment with the surfaces of the upright plate to permit such tab to penetrate into the slot to its final position. Alternately, the transverse connector plate may be bent so that it requires flattening to be fitted into the web slot. Being elastically resilient, the plate will attempt to resume a bent condition, once in the slot, causing it to be jammed in place.

A further feature of the invention is that runners may be joined end-to-end by an engagement piece that embraces the webs or both runners. In this variant the web of one runner replaces a connection plate.

Due to the minimal and near-zero head space requirements of the invention, an existing drop ceiling that needs painting or cleaning may be left in place with a new second ceiling installed directly below and adjacent to the existing drop ceiling through use of joining pieces. Existing runners of a conventional drop ceiling may support clamps of the invention through joining pieces which attach to the existing runners. Coupling means, such as threaded fasteners may be employed to hold the clamps in place beneath the joining pieces.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
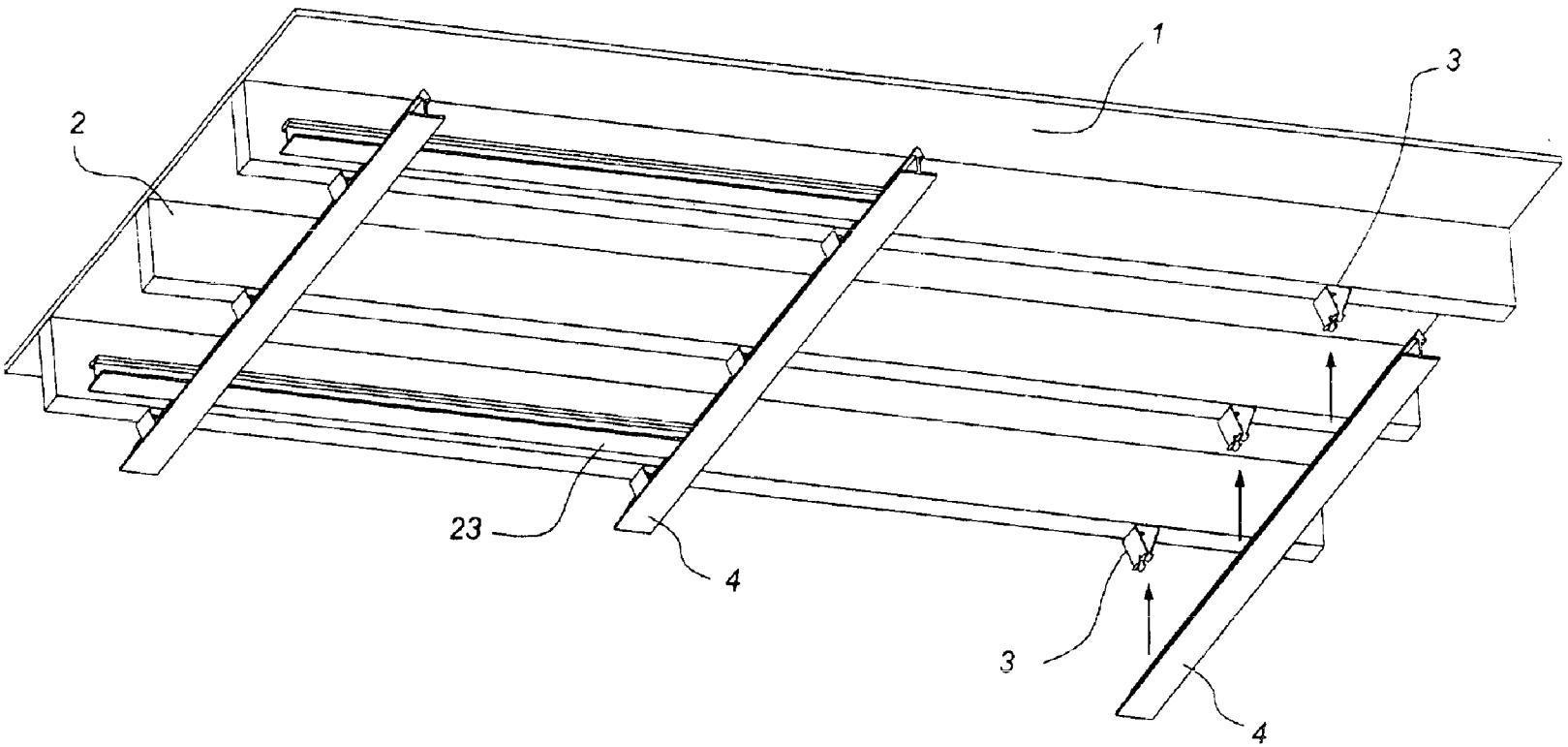
FIG. 1 is a pictorial view of a ceiling fitted with runners for the suspended ceiling system of the invention.

In FIG. 1 a structural ceiling 1 includes joists 2 to which are fastened clamps 3 according to the invention. Runners 4 snap into the clamps 3 to provide support for ceiling panels 5 (not shown in FIG. 1).

Figure 2:
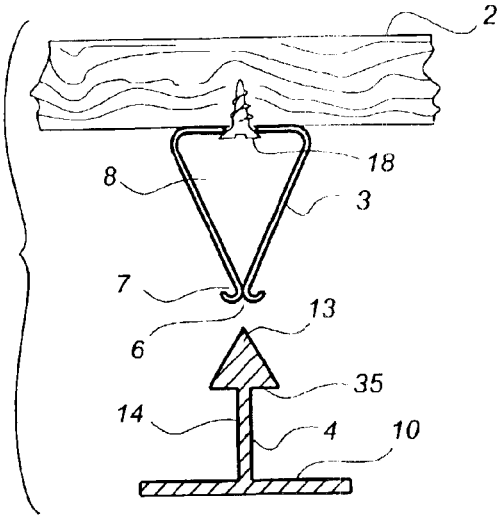
FIG. 2 is an end view of a cross-sectional runner positioned for entry into a clamp fastened to a joist.
Figure 3:
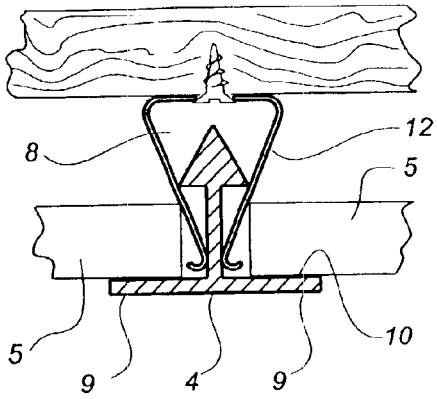
FIG. 3 is an end view of the runner of FIG. 2 engaged with the clamp.

In FIG. 2 a runner 4 is about to have its peripheral clamp-penetrating end portion 13 arrow-head shaped in cross section and carried by the clamp penetration leg constituted by the runner's web 14, pressed through the nip 6 formed by lips 7 to penetrate the interior space 8 within the clamp 3, c.f. FIG. 3. In this process, ceiling panels 5 may be carried-up with the runners 4, resting on lateral flanges 9 that provide ledges 10 for the ceiling panels 5 to rest on.

While the ceiling panels 5 are shown as resting on the ledges 10, such ledges 10 may penetrate slots (not shown) in the edge faces of the panels 5 to support the panels 5.

The clamp 3 has sides 12 as shown in FIG. 3 that are tapered proceeding towards the nip 6. The angle between the side portions 12 may be optionally more obtuse in the side portions 12 proximate to the nip 6. This provides an increased resistance to removal of the engagement edge 13 on the runner 4 from the clamps 3.

Figure 4:
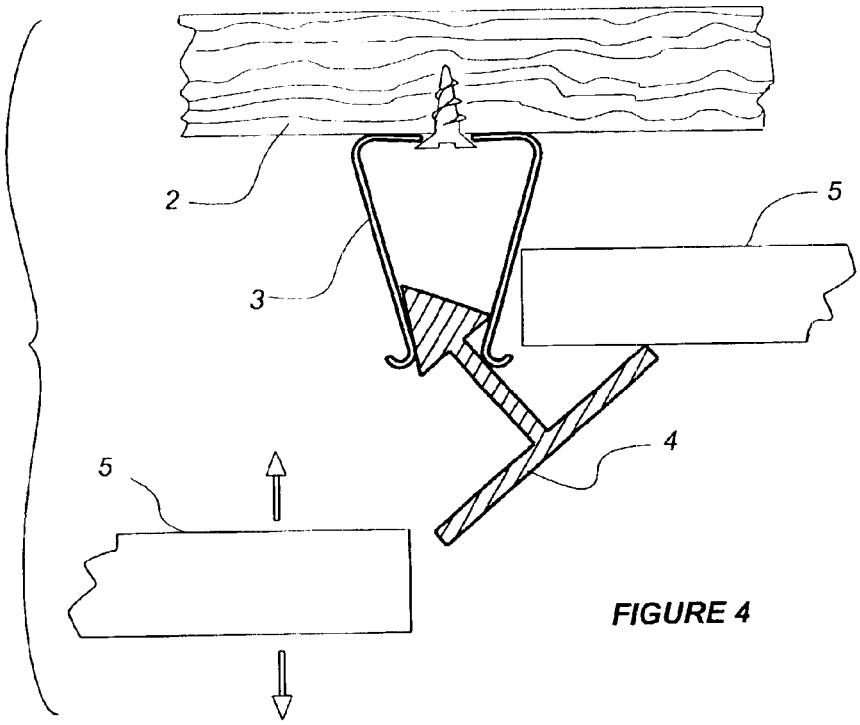
FIG. 4 is an end view of the runner of FIG. 3 partially lowered within the clamp to a canted orientation to receive or remove a ceiling panel.

In FIGS. 2 and 3 the runners 4 are aligned with the web portion 14 on the runner 4, being in a vertical orientation. In FIG. 4 the runner 4 is canted sideways to allow for removal or insertion of a ceiling panel 5. This process is further detailed in FIGS. 18–18B.

Figure 5:
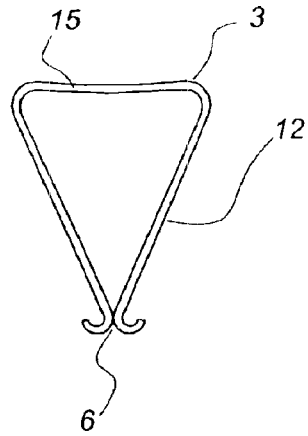
FIG. 5 is an end view of a clamp.
Figure 6:
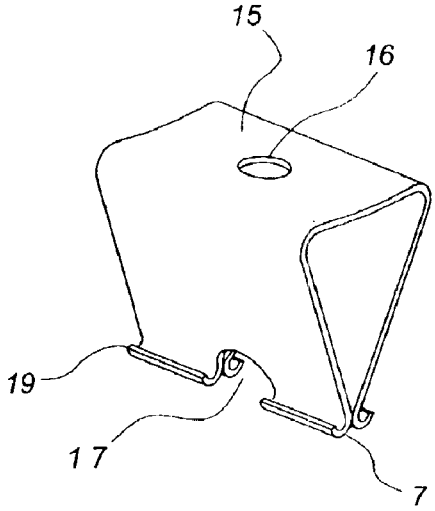
FIG. 6 is a pictorial view of the clamp of FIG. 5 with notches to provide access for a tool to actuate a fastener.

As shown in FIGS. 5 and 6 the clamp 3 has a base 15 that may be inwardly bowed and pierced by a fastener opening 16. An access notch 17 is formed in the lips 7 to provide access for a tool (not shown) to fastener 18 present in the fastener opening 16. The lips 7 of the clamp 3 may have a slight outward curl 19 to permit ready spreading of the lips 7 by the engagement edge 13 of the runners 4.

Figure 7:
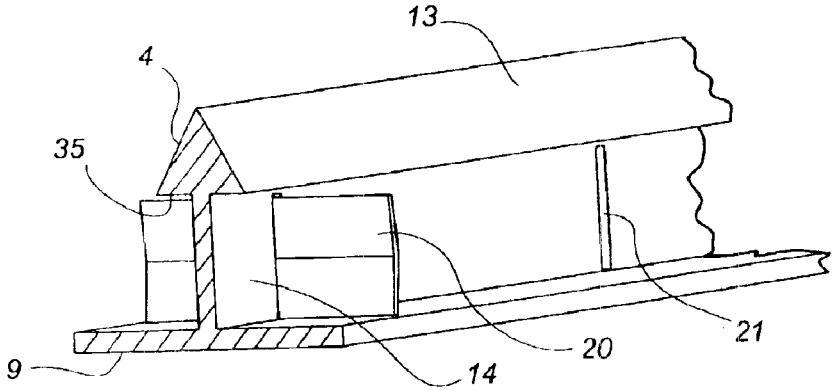
FIG. 7 is a pictorial view of a runner with slots for transverse plates.
Figure 8:
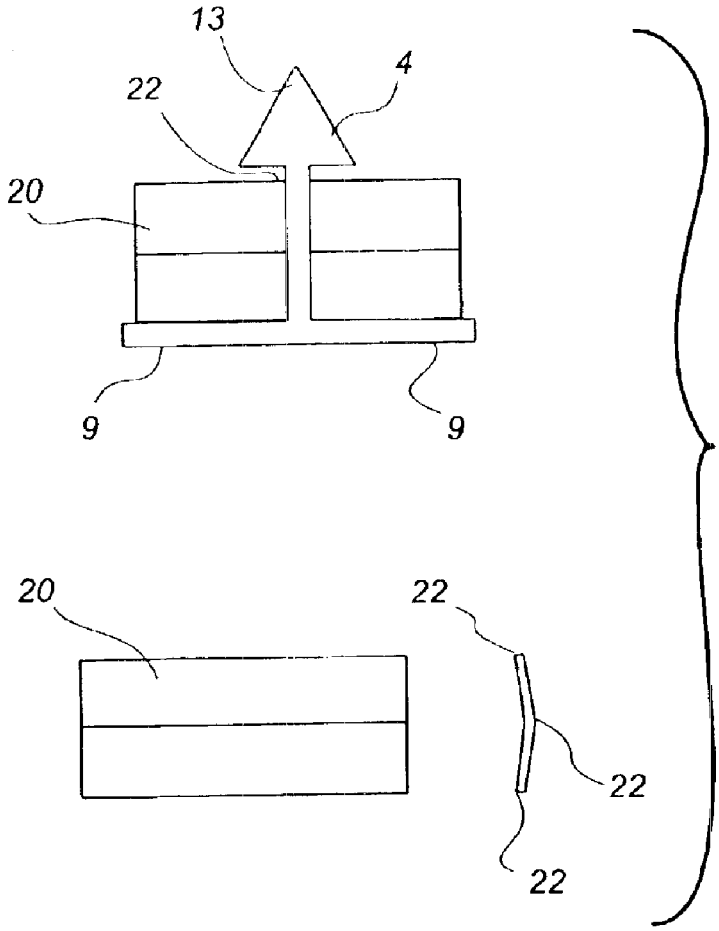
FIG. 8 provides face and end views of a bent connector plate.
Figure 9:
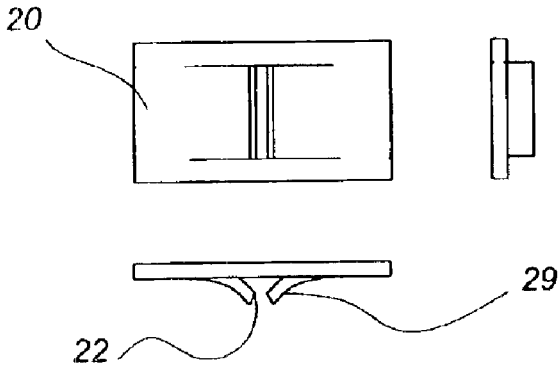
FIG. 9 provides plan and front edge views of a transverse plate with locking tabs.

As shown in FIG. 7, a transverse connector plate 20 is fitted into a slot 21 in the web 14 of a longitudinal runner 4, preferably stabilized by the lower side 35 of the enlarged, engagement end portion 13. This plate 20 generally rests on and largely spans both lateral flanges 9. The connector plate 20 as shown in FIG. 8 maybe pre-bent, to be elastically flattened for insertion into the slot 21. Upon release, the elastic tendency of the plate 20 to assume its bent form will jam it within its slot, aided optionally be a notch in the plate (not shown). Alternately, as in FIG. 9, resilient tabs 29 erupted from the plate 20 may serve as fingers with web-engaging edges 22 which bear against the runner web 14 along the sides of the slot 21 to stabilize the plate 20 in place.

Figure 10:
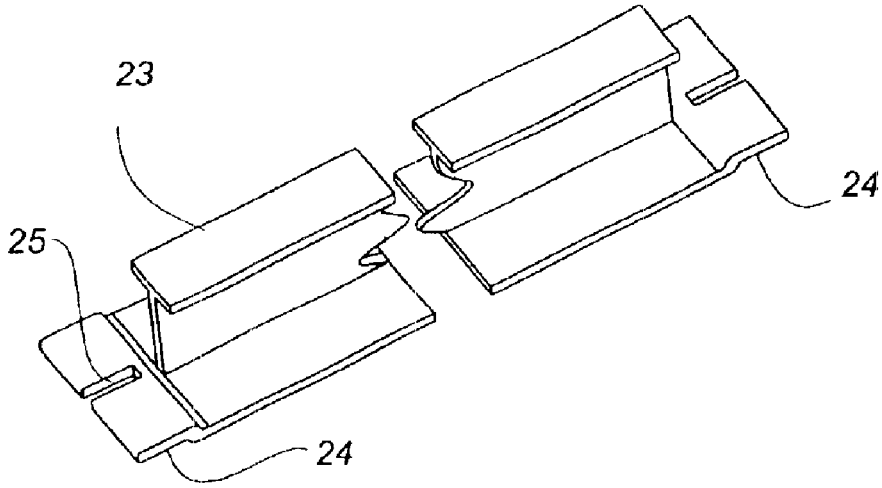
FIG. 10 is a pictorial view of a cross-runner with a stepped and notched end.
Figure 11:
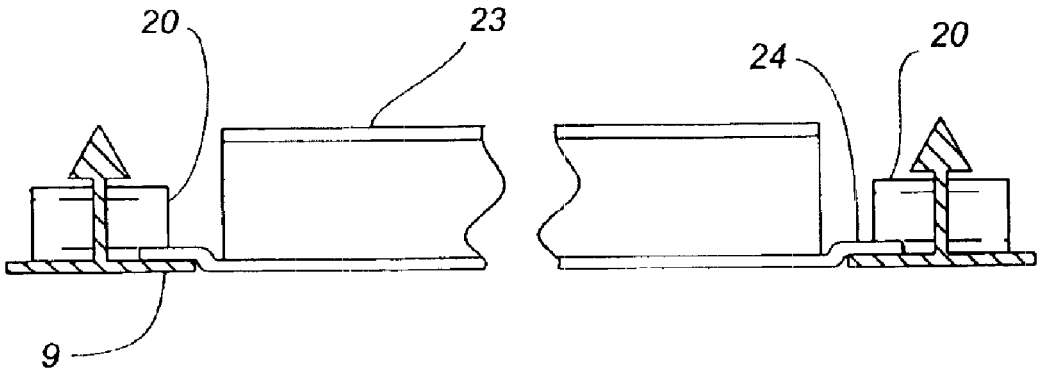
FIG. 11 depicts the cross-runner of FIG. 10 positioned to rest on the runner of FIG. 7.

As shown in FIGS. 10 and 11, cross runners 23 of "I" beam cross-section may be provided that have at their respective outer ends a upwardly-stepped, protruding, ledge-engaging end surface 24 that is notched with a notch 25 to rest on a flange 9 with the notch 25 fitted into a transverse connector plate 20—c.f. FIG. 11.

Figure 12:
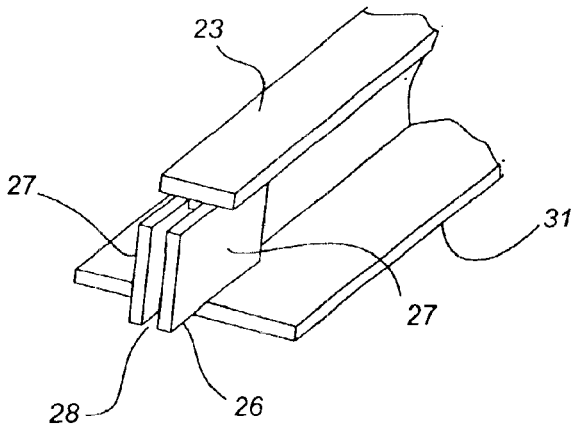
FIG. 12 is a pictorial view of an engagement piece fitted to the end of a cross-runner shaped as in FIG. 7 with a pair of plates extending beyond the cross-runner.
Figure 13:
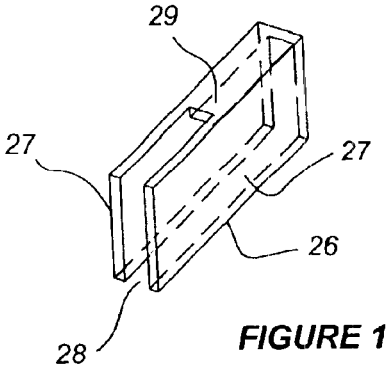
FIG. 13 is a pictorial view of the engagement piece with a bridge positioned to fit into a notch in the web at the end of a cross runner.
Figure 14:
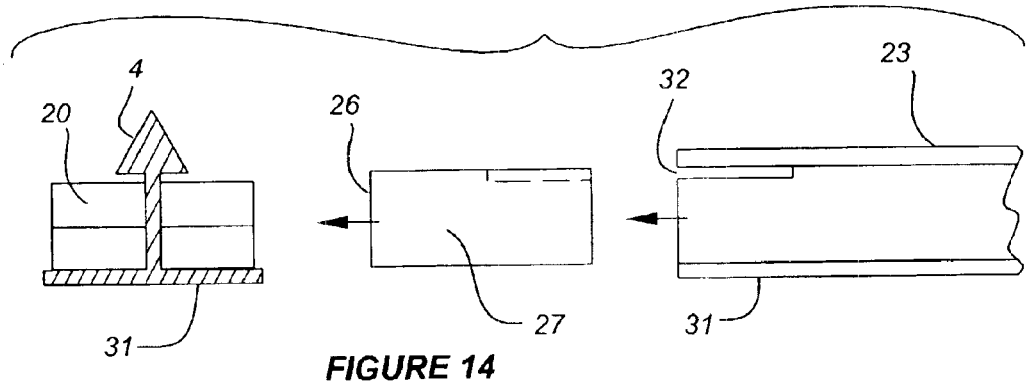
FIG. 14 is an exploded side view of a cross-runner as in FIG. 12 with an engagement piece as in FIG. 13 fitted to rest on a runner as in FIG. 7.

As an alternative to providing integrally-formed engaging ends 24, separate engagement pieces 26 may be fitted to the end of a cross-runner 23 without the stepped surfaces 24, as shown in FIG. 12. Using engagement pieces 26, it is also optionally possible to use longitudinal runner 4 stock to serve as cross runners 23. The following description applies in either case. Two vertical side plates 27 on the engagement piece 26, joined by a bridge 29, form a central, connector-embracing slot 28. The slot 28 also embraces the web of the cross-runner. The bridge 29 fits optionally into a web slot 32 in the web 14 of the cross-runner 23. Alternately, the connector plate 20 is shortened to a length to provide space for a vertical bridge spanning between the side plates 27. The engagement piece may then be contained on the web of the cross-runner between the lateral flanges and the upper enlargement on the cross runner as provided by the top flange on the cross runner. The connector-embracing slot 28 allows the side plates 27 to extend to the runner web 14 and embrace the connector plate 20. When a cross-runner 23 of appropriate dimensions is so presented and fitted to a longitudinal runner 4, the lower faces 31 of both runners will be approximately co-planar, ensuring the cross runner 23 and the longitudinal runner 4 are aligned with each other.

Figure 15:
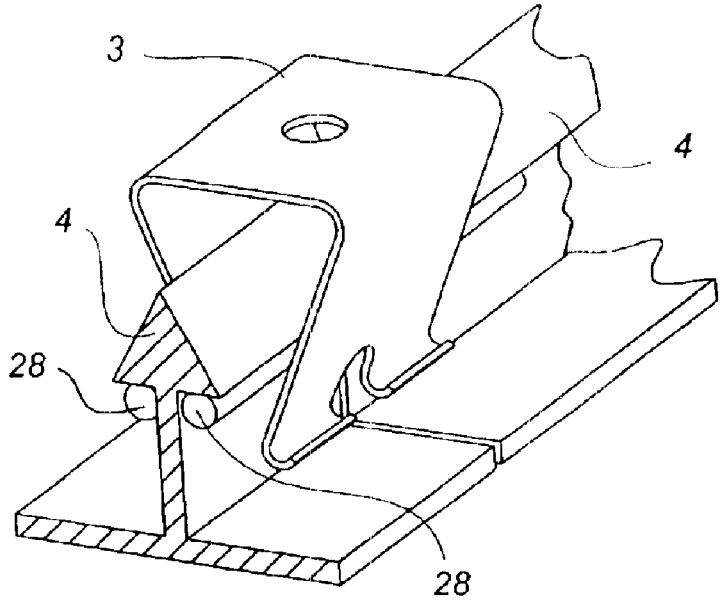
FIG. 15 is a pictorial view of two runners as in FIG. 7 joined end-to-end by a clamp and two dowels.
Figure 16:
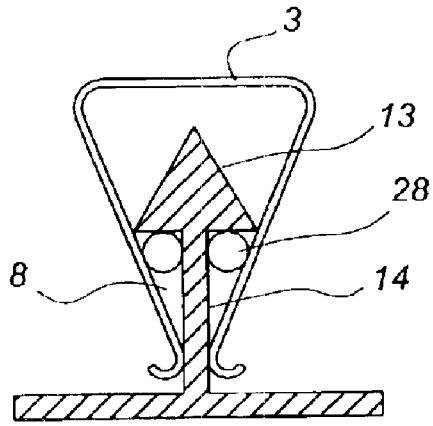
FIG. 16 is a cross-sectional end view through the clamp, runner and dowels of FIG. 15.

FIGS. 15 and 16 show the abutting connection of the ends of runners 4 using a pair of dowels 28. The dowel diameter is preferably selected to fill, together with the enlarged peripheral end portion 13 and web 14 of a runner 4, the gap within interior space 8 of a clamp 3, beneath the peripheral end portion 13. This ensures the true alignment of adjacent runners 4.

Figure 17:
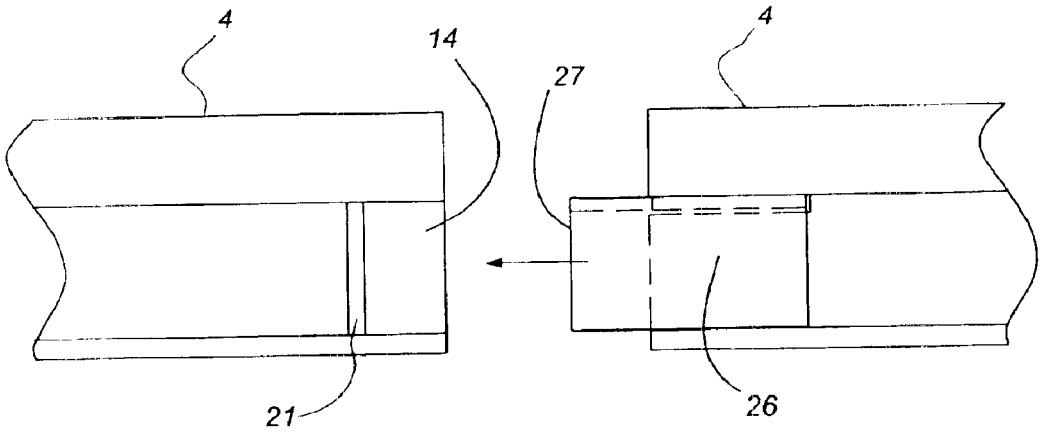
FIG. 17 is an exploded side view of two abutting runners as in FIG. 7 being joined by an engagement piece as shown in FIG. 13.
Figure 17A:
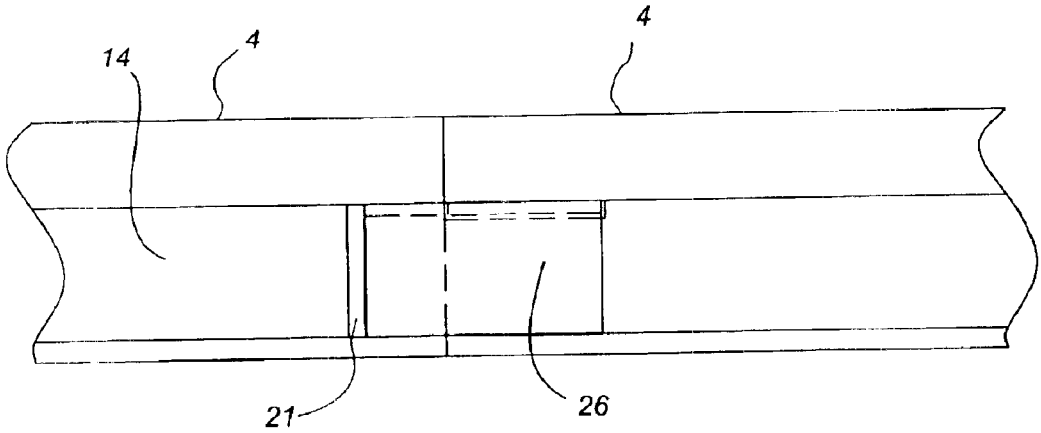
FIG. 17A is an assembled view of FIG. 17.

Abutting runners 4 may also be joined end-to-end using engagement pieces 26 as shown in FIGS. 17, 17A. FIG. 17A shows the abutting runners fully abutted and stably joined through piece 26. The vertical plates 27 extending from the end of one runner 4 embrace the web 14 on an adjacent abutting runner 4. The web slot 21 is located sufficiently spaced from the runner end to allow the web 14 to be fully embraced.

Figure 18:
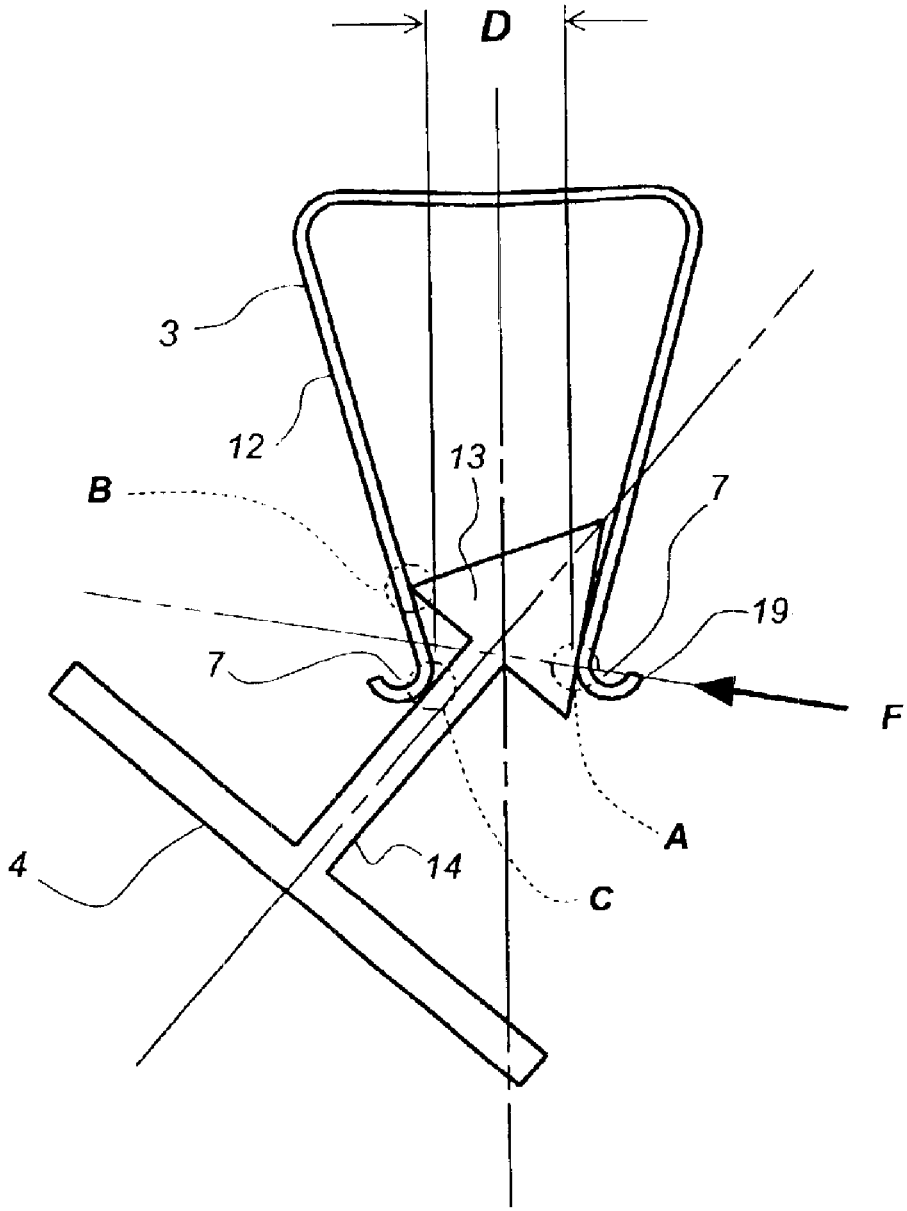
FIG. 18 is an end view showing details of a canted runner as in FIG. 4 that is canted in one of its three bistable positions.

In FIG. 18 an enlarged detail of an arrow-headed peripheral end portion 13 grasped by lips 7 of a clamp 3 at a canted orientation is depicted. The runner 4 is in a stable orientation when canted sideways because the lips 7 must separate, at least slightly, if the runner 4 is rotated in either lateral direction. A variety of cross-sectional shapes can be provided for the peripheral end portion 13 to meet this criterion. In FIG. 18, the contact force F at contact point A is directed to pass between contact points B and C to provide for maximum stability. In FIG. 18, the runner 4 is obliquely canted in a left orientation relatively to the clamp. Of course, the runner 4 may assume a second stable orientation where the runner is obliquely canted at an identical angle in an opposite orientation with respect to the clamp. In the stable position shown in FIG. 18, the lips 7 of the clamp are separated by a distance D.

Figure 18A:
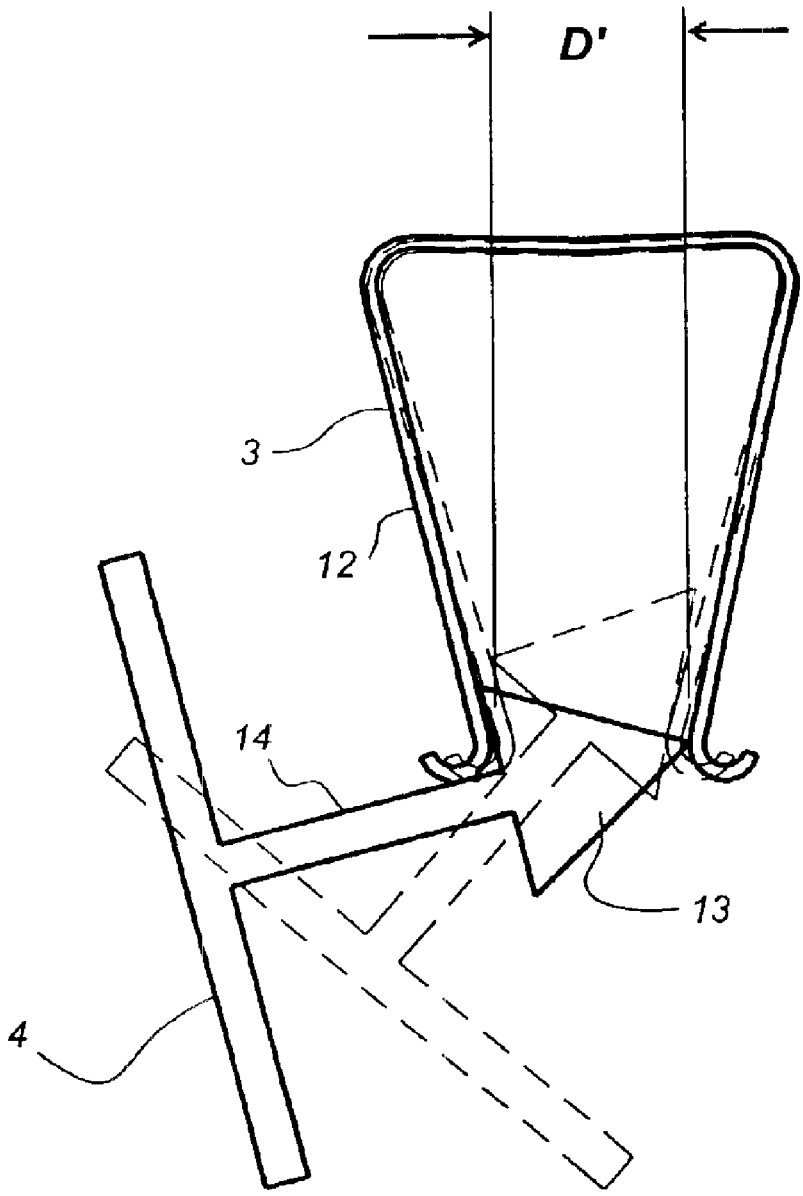
FIG. 18A is an end view showing details of the canted runner of FIG. 18 with the runner rotated slightly in one direction to spread the clamp lips to just short of the break-through limit, generating a restoring force.

Upon slightly changing the orientation of the runner within the clamp by effecting a small rotation, the distance D separating the lips 7 changes. Referring to FIG. 18A, the arrow-headed peripheral end portion 13 grasped by lips 7 of the clamp means is partially rotated clockwise relatively to the stable position of FIG. 18, which is shown in dotted lines. When the runner 4 is positioned in such orientation, the lips 7 of the clamp 3 are spaced apart by a distance D' which is larger than the distance D. The same effect arises if a small rotation is attempted in the counter-clockwise direction.

This spreading provides a restoring force that ensures that the orientation of FIG. 18, and its mirror counterpart, are stable orientations.

On the basis of the foregoing, a cost-effective and labor-efficient system is provided for installing ceiling panels for a drop ceiling.

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A supporting framework for a suspended ceiling comprising:

(a) a plurality of longitudinal ceiling runners each being generally of an inverted "T" shape in cross-section and comprising:

i) a pair of laterally extending support flanges providing ledge surfaces for carrying ceiling panels; and ii) an upwardly directed, clamp-penetrating leg with a web portion extending from said support flanges and terminating at a peripheral clamp-penetrating end portion; and, (b) a plurality of clamps each having a baseplate with a fastening hole and resiliently expandable sides terminating at a pair of lips defining a nip to provide a retention force, said baseplate and sides defining an internal receiving space for receiving the clamp-penetrating end portion of the leg of the runner, wherein said clamp-penetrating end portion of each runner is positionable within said receiving space and is of a shape compatible for being engaged by said clamps to permit the runner to alternately maintain either of the following first and second stable orientations:

(c) a first stable orientation, wherein the clamp penetrating leg is engaged by the clamps with the flanges in a central, symmetrically aligned, horizontal orientation, and (d) a second stable orientation wherein the clamp penetrating leg and the lateral flanges are obliquely canted with respect to the nip and the baseplate, whereby when the runner is slightly rotated about either of said stable orientations said lips are spread apart to provide a restoring force which establishes said stable orientation, and wherein said runners are positionable with respect to said clamps with respect to said clamps with said flanges being generally parallel to said base plate in one of said first stable orientation, and with said flanges being canted at an angle to said base plate in said second stable orientation.

2. A method of installing ceiling panels of a suspended ceiling comprising the steps of:

(1) providing a plurality of resilient clamps and fastening such clamps in place in parallel rows beneath components of a structural ceiling, said clamps each having a baseplate and resiliently expandable sides terminating at a pair of lips that define a nip, said baseplate and sides defining an internal receiving space;

(2) providing a plurality of longitudinal ceiling runners which are generally of an inverted "T" shape in cross-section each runner having a pair of laterally extending support flanges that provide ledge surfaces for carrying ceiling panels, and an upwardly directed clamp-penetrating leg having a web portion with a peripheral clamp-engaging end portion, wherein said clamp-engaging end portion is of a shape which permits the runner to maintain at least the following stable orientations with respect to the clamp when the clamp is engaged with the runner, namely:

i) a first stable orientation, wherein the clamp penetrating leg is inter-engaged beneath the clamp means with the flanges in a central, symmetrically aligned horizontal orientation, and ii) a second stable orientation wherein the clamp penetrating leg and the lateral flanges are obliquely canted with respect to the nip and the baseplate, (3) forming parallel rows of installed runners by placing the peripheral, clamp-penetrating end portion of each of said runners at the nips of a row of said clamps and pressing such end portions through the lips of said clamps to penetrate into the internal receiving space of the clamp whereby the runner is held in place by the clamp through the action of the lips grasping the web portion of the runner with the peripheral end portion of the clamp-engaging leg within said internal receiving space;

(4) canting at least one of said runners out of alignment with the orientation of an adjacent parallel runner to provide space for a ceiling panel to be placed between said canted runner and said another runner, (5) inserting a ceiling panel therebetween; and, (6) realigning said runners to retain the ceiling panel in place.

3. A framework as in claim 1 wherein:

(1) the clamp-penetrating end portion of the runner is pointed and tapered with a tapered entry surface that provides an easy entry and passage of such edge through the lips of the nip, and (2) the runner is provided with a grasping surface on the flange side of said peripheral end portion which permits the tapered surface and said grasping surface to be grasped between the lips of a clamp when the runner is canted obliquely to assume the second of said stable orientations.

4. A framework as in claim 3 wherein the peripheral end portion is arrow-head shaped in cross-section.

5. A framework as in claim 1 wherein:

(1) the clamps are generally triangular in cross-section with the baseplate of the clamp dished inwards into the interior receiving space of the clamp; and (2) a fastening hole is formed in the baseplate for a fastener to pass therethrough to engage with the structural ceiling, whereby the retention force at the nip of the clamp can be varied in accordance with the tightness with which a fastener engages the structural ceiling.

6. A framework as in claim 1 wherein the sides of the clamp are notched along the lips to provide access for a fastener engagement tool to reach a fastener positioned in the fastening hole.

* * * * *